US008676091B2

(12) United States Patent
Otsuka et al.

(10) Patent No.: US 8,676,091 B2
(45) Date of Patent: Mar. 18, 2014

(54) CHARGING DEVICE AND IMAGE FORMING APPARATUS

(75) Inventors: Koji Otsuka, Kanagawa (JP); Yuki Nagamori, Kanagawa (JP); Arichika Tanaka, Kanagawa (JP); Tomoyoshi Chihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 250 days.

(21) Appl. No.: 13/193,162

(22) Filed: Jul. 28, 2011

(65) Prior Publication Data

US 2012/0230732 A1 Sep. 13, 2012

(30) Foreign Application Priority Data

Mar. 9, 2011 (JP) ..... 2011-051627

(51) Int. Cl.
*G03G 15/02* (2006.01)

(52) U.S. Cl.
USPC ..... 399/171

(58) Field of Classification Search
USPC ..... 399/171
See application file for complete search history.

(56) References Cited

U.S. PATENT DOCUMENTS

| | | | | |
|---|---|---|---|---|
| 5,226,428 | A * | 7/1993 | Lee | 600/590 |
| 6,553,198 | B1 * | 4/2003 | Slattery et al. | 399/171 |
| 6,823,157 | B2 * | 11/2004 | Foltz | 399/171 |
| 7,123,860 | B1 * | 10/2006 | Zona | 399/171 |
| 7,430,388 | B2 * | 9/2008 | Zona et al. | 399/171 |
| 7,885,578 | B2 | 2/2011 | Yoshino | |

* cited by examiner

*Primary Examiner* — Clayton E LaBalle
*Assistant Examiner* — Leon W Rhodes, Jr.
(74) *Attorney, Agent, or Firm* — Sughrue Mion, PLLC

(57) ABSTRACT

A charging device includes a discharge electrode that extends along a rotational axis direction of a member to be charged that rotates and has an arc-shaped outer peripheral surface, the discharge electrode being arranged to face the outer peripheral surface; a potential control plate arranged between the outer peripheral surface of the member to be charged and the discharge electrode and extending in the rotational axis direction of the member to be charged, the potential control plate being plastically deformed so as to independently maintain the shape of the potential control plate; and a support member that supports the potential control plate only at both end portions of the potential control plate in a long-side direction of the potential control plate.

12 Claims, 10 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2011-051627 filed Mar. 9, 2011.

BACKGROUND

The present invention relates to a charging device and an image forming apparatus.

SUMMARY

According to an aspect of the invention, there is provided a charging device including a discharge electrode that extends along a rotational axis direction of a member to be charged that rotates and has an arc-shaped outer peripheral surface, the discharge electrode being arranged to face the outer peripheral surface; a potential control plate arranged between the outer peripheral surface of the member to be charged and the discharge electrode and extending in the rotational axis direction of the member to be charged, the potential control plate being plastically deformed so as to independently maintain the shape of the potential control plate; and a support member that supports the potential control plate only at both end portions of the potential control plate in a long-side direction of the potential control plate.

BRIEF DESCRIPTION OF THE DRAWINGS

An exemplary embodiment of the present invention will be described in detail based on the following figures, wherein.

DETAILED DESCRIPTION

Figure 1:
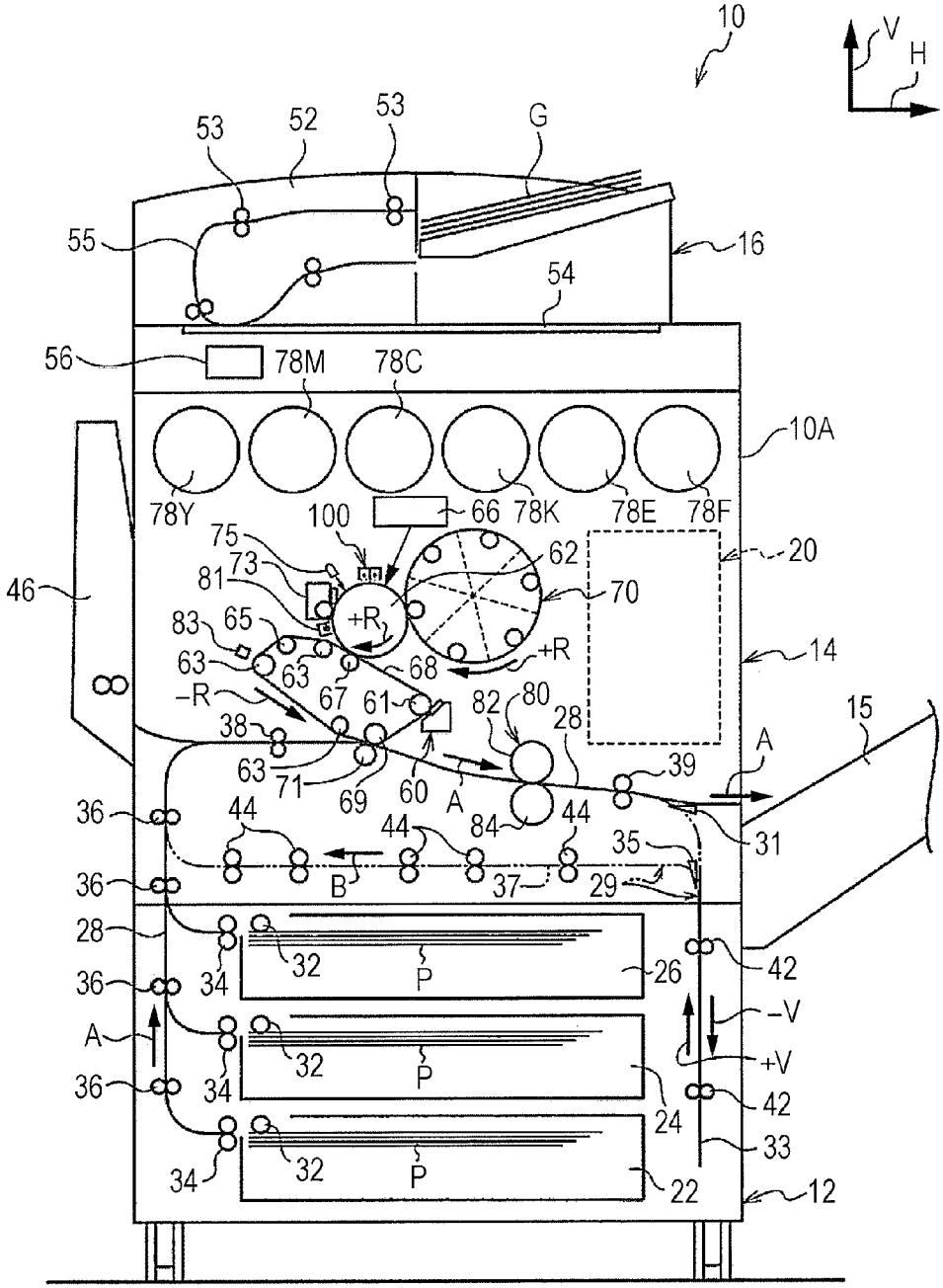
FIG. 1 illustrates the structure of an image forming apparatus according to an exemplary embodiment.

An exemplary embodiment of the present invention will be described in detail with reference to the drawings. Structure of Image Forming Apparatus of Exemplary Embodiment First, the structure of an image forming apparatus according to the present exemplary embodiment will be described. FIG. 1 is a schematic diagram illustrating the structure of an image forming apparatus 10 according to the present exemplary embodiment.

The image forming apparatus 10 includes a sheet storing unit 12 in which sheets of recording paper P, which are examples of recording media, are stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction and the horizontal direction with respect to an apparatus body 10A of the image forming apparatus 10 will be referred to as the direction of arrow V and the direction of arrow H, respectively.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image.forming apparatus 10, an upstream part of the transport path 28 extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow V from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H. The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The sheets of recording paper P may be fed to the positioning rollers 38 on the transport path 28 from the manual sheet-feeding unit 46.

The original-document reading unit 16 includes a document transport device 52 that transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54. The document transport device 52 includes a transport path 55 along which pairs of transport rollers 53 are arranged. A part of the transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical or columnar photoconductor 62 which is an example of a member to be charged that rotates and has an arc-shaped outer peripheral surface. The photoconductor 62 is arranged in a substantially central area of the apparatus body 10A. The photoconductor 62 is rotated in the direction shown by arrow +R (clockwise in FIG. 1) by a driving unit (not shown), and carries an electrostatic latent image formed by irradiation with light. The surface of the photoconductor 62 is coated with an overcoat layer that reduces ablation of the surface of the photoconductor 62. In addition, a scorotron charging device 100 that charges the outer peripheral surface of the photoconductor 62 is provided above the photoconductor 62 so as to face the outer peripheral surface of the photoconductor 62. The detailed structure of the charging device 100 will be described below.

An exposure device 66 is provided so as to face the outer peripheral surface of the photoconductor 62 at a position downstream of the charging device 100 in the rotational direction of the photoconductor 62. The outer peripheral surface of the photoconductor 62 that has been charged by the charging device 100 is irradiated with light (exposed to light) by the exposure device 66 on the basis of an image signal corresponding to each color of toner. Thus, an electrostatic latent image is formed.

A rotation-switching developing device 70 is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

Figure 2:
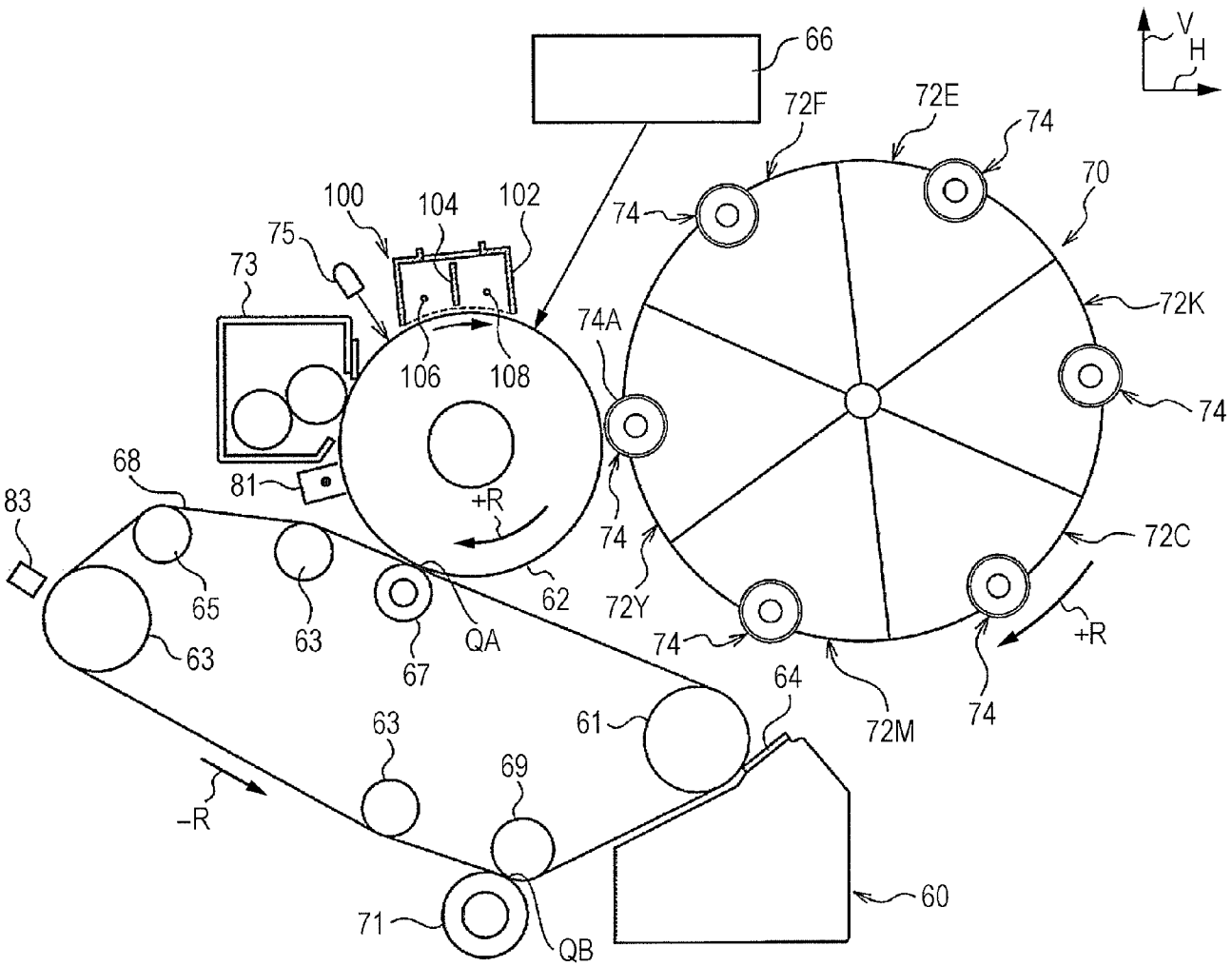
FIG. 2 illustrates the structure of an area around a photoconductor according to the exemplary embodiment.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The position at which each developing unit is opposed to the outer peripheral surface of the photoconductor 62 is a developing position at which the developing process is performed. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y is filled with developer (not shown) including toner and carrier. The developer is supplied from the toner cartridge 78Y (see FIG. 1) through a toner supply channel (not shown). The developing unit 72Y is provided with a developing roller 74 having an outer peripheral surface that faces the outer peripheral surface of the photoconductor 62.

The developing roller 74 moves the developer layer on the outer peripheral surface of the developing sleeve 74A to the position where the developing sleeve 74A faces the photoconductor 62. Accordingly, the toner adheres to the latent image (electrostatic latent image) formed on the outer peripheral surface of the photoconductor 62. Thus, the latent image is developed.

Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is an example of a transfer unit, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 60, which is an example of a developer collecting device, is opposed to the driving roller 61 with the intermediate transfer belt 68 interposed therebetween. The cleaning device 60 collects residual toner that remains on the intermediate transfer belt 68 after the second transfer process. The cleaning device 60 includes a cleaning blade 64 that comes into contact with the intermediate transfer belt 68 to remove the toner from the intermediate transfer belt 68. The cleaning blade 64 of the cleaning device 60 and the second transfer roller 71 are separated from the outer peripheral surface of the intermediate transfer belt 68 until the toner images of the respective colors are transferred onto the intermediate transfer belt 68 in a superimposed manner (first transfer process) and then transferred onto the sheet of recording paper P (second transfer process).

A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade and a brush roller that are in contact with the surface of the photoconductor 62. An erase device 81 is provided upstream of the cleaning device 73 and downstream of the first transfer roller 67 in the rotational direction of the photoconductor 62. The erase device 81 eliminates the charge history left by the first transfer roller 67 by discharging electricity toward the outer peripheral surface of the photoconductor 62. The erase device 81 discharges negative electricity toward the outer peripheral surface of the photoconductor 62 before the residual toner and the like are collected by the cleaning device 73. Accordingly, the history of positive electric charge left by the first transfer roller 67 is eliminated, and the image forming process of the next cycle is prevented from being affected by the electric charge. An erase unit 75 that irradiates the outer peripheral surface of the photoconductor 62 with light to eliminate the history of the negative electric charge is provided downstream of the cleaning device 73 and upstream of the charging device 100.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71. The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the six colors, which are Y, M, C, K, E, and F will be described as an example. However, as another example, the image forming process may be performed using five colors, which are Y, M, C, K, and one of the first and second specific colors E and F.

Structure of Charging Device 100

The structure of the charging device 100 will now be described.

As illustrated in FIG. 2, the charging device 100 includes a shield case 102 made of aluminum as an example of a housing that is open at the side opposed to the photoconductor 62. The shield case 102 has the shape of a long box (see FIG. 3) that extends in a rotational axis direction of the photoconductor 62. As illustrated in FIG. 2, a partition plate 104 is provided in the shield case 102 so as to divide the inner space of the shield case 102 at a central position thereof in the width direction (rotational direction of the photoconductor 62).

Discharge wires 106 and 108, which are examples of discharge electrodes, are arranged in the shield case 102 at either side of the partition plate 104. The discharge wires 106 and 108 are opposed to the outer peripheral surface of the photoconductor 62 and extend in the rotational axis direction of the photoconductor 62. The discharge wires 106 and 108 are formed of metal wires made of tungsten or the like. The discharge electrodes may instead be discharge members formed of wires coated with resin or metal plates, and are not limited as long as the discharge electrodes are capable of discharging electricity.

The discharge wires 106 and 108 generate a negative charge when a voltage is applied thereto from a power source (not shown), and performs a discharging operation of supplying the negative charge to the surface of the photoconductor 62. The photoconductor 62 is charged with electricity as a result of this discharging operation.

A grid 110, which is an example of a potential control plate, is disposed between the photoconductor 62 and the discharge wires 106 and 108 at the open side of the shield case 102. The grid 110 extends along the rotational axis direction of the photoconductor 62. The grid 110 is formed of a metal plate including a portion having a mesh pattern, and is curved along the outer peripheral surface of the photoconductor 62.

The grid 110 extends in the rotational axis direction of the photoconductor 62. In other words, the long-side direction of the grid 110 extends along the rotational axis direction of the photoconductor 62, and the short-side direction of the grid 110 extends along the rotational direction of the photoconductor 62. The grid 110 is not limited to those having a mesh pattern, and slits, for example, may instead be formed therein. The grid 110 is not limited as long as plural openings are formed.

The negative charge generated by the discharge wires 106 and 108 is supplied to the photoconductor 62 through the openings formed in the grid 110. The amount of negative charge that passes through the grid 110 is controlled by a grid voltage, which is controlled by a controller (not shown). Thus, the charge potential of the photoconductor 62 is controlled.

More specifically, in the case where the voltage (potential) of the grid 110 is higher than the potential of the photoconductor 62, the negative charge moves toward the photoconductor 62 due to the potential difference between the photoconductor 62 and the grid 110. Accordingly, a large amount of negative charge passes through the grid 110. When the negative charge is supplied to the photoconductor 62, the potential difference between the photoconductor 62 and the grid 110 decreases. Accordingly, the amount of negative charge that passes through the grid 110 decreases. Thus, when the grid voltage of the grid 110 is high, compared to the case in which the grid voltage is low, the amount of negative charge that passes through the grid 110 is increased and the charge potential of the photoconductor 62 is increased accordingly.

Figure 4:
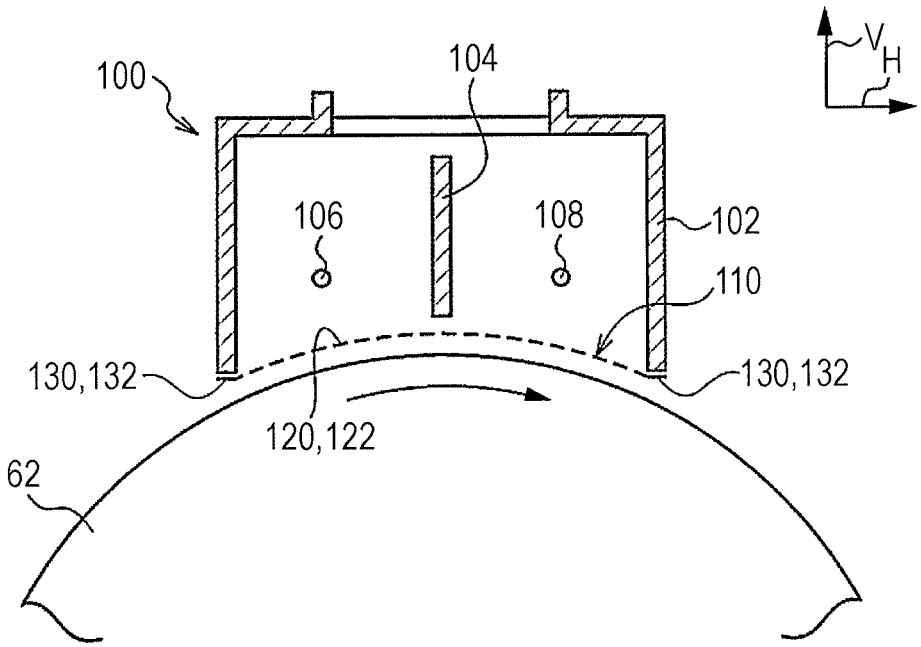
FIG. 4 is a schematic sectional view illustrating the structure of the charging device according to the exemplary embodiment.
Figure 5:
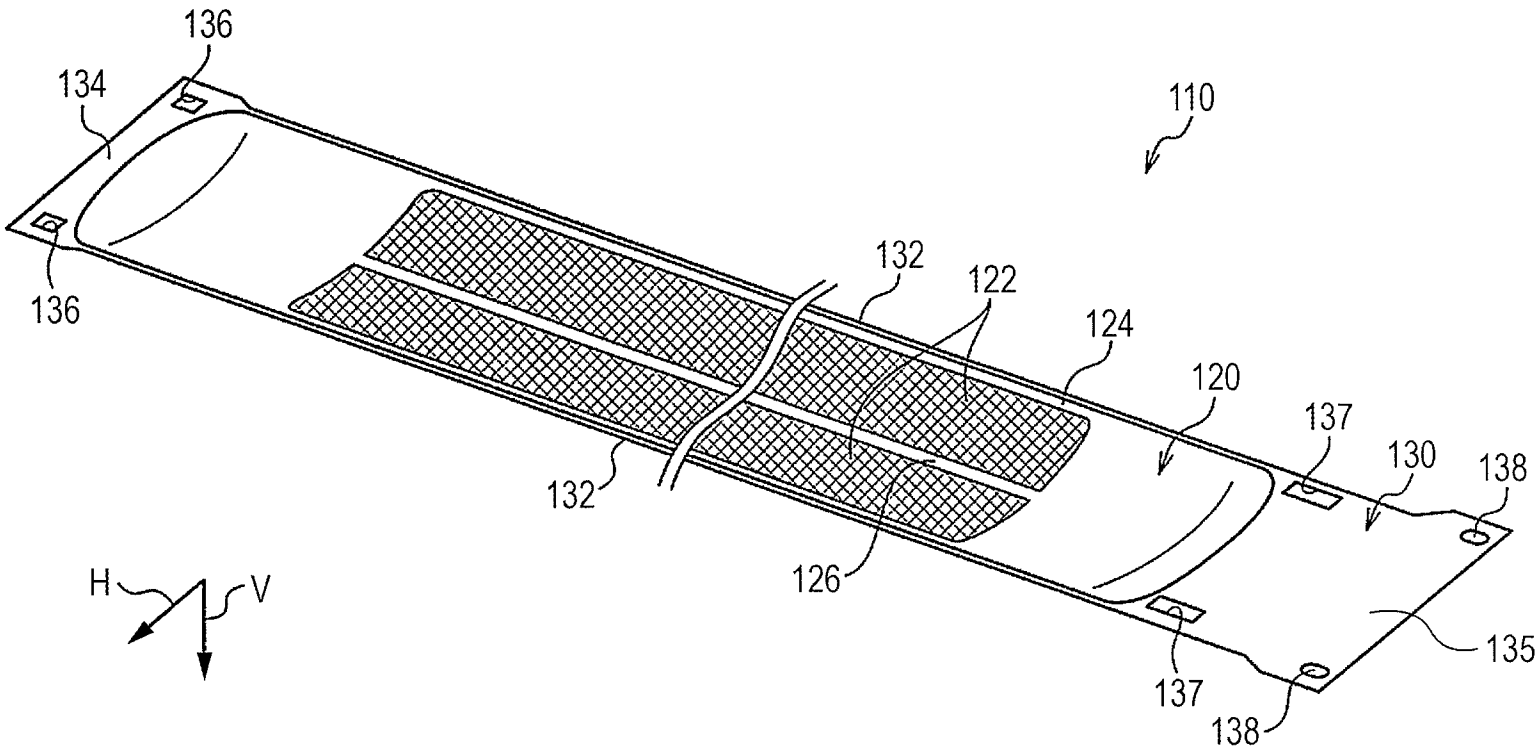
FIG. 5 is a perspective view illustrating the structure of a grid according to the exemplary embodiment.

Referring to FIGS. 4 and 5, the grid 110 includes a curved portion 120 that is curved so as to project toward the discharge wires 106 and 108 and a frame portion 130 provided at the outer periphery of the curved portion 120 so as to surround the curved portion 120.

The frame portion 130 is formed of a flat plate. The frame portion 130 includes a pair of linear portions 132 and wide portions 134 and 135. The linear portions 132 linearly extend in the rotational axis direction of the photoconductor 62 at the upstream and downstream ends of the curved portion 120 in the rotational direction of the photoconductor 62. The wide portions 134 and 135 extend from one of the linear portions 132 to the other one of the linear portions 132 at either end of the curved portion 120 in the rotational axis direction of the photoconductor 62.

One wide portion 134 (wide portion at the upper left in FIG. 5) has two hook holes 136 to which hook portions 162, which will be described below, are engaged. The other wide portion 135 (wide portion at the lower right in FIG. 5) has two hook holes 138 to which torsion springs 172, which will be described below, are engaged and two insertion holes 137 into which contact portions 174, which will be described below, are inserted.

The curved portion 120 is provided with a mesh portion 122 having a mesh pattern. The mesh portion 122 may have, for example, a grid pattern composed of rectangles or a honeycomb pattern composed of hexagons.

A frame portion 124 that surrounds the mesh portion 122 is provided at the outer periphery of the mesh portion 122. The mesh portion 122 is provided with a separating portion 126 that extends in the long-side direction of the grid 110 so as to divide the mesh portion 122 into two areas at a central position thereof in the short-side direction of the grid 110.

The mesh portion 122 is arranged to face an image area (area to be charged) of the photoconductor 62, and is curved along the outer peripheral surface of the photoconductor 62 at least in this area. More specifically, the mesh portion 122 and a part of the frame portion 124 are plastically deformed in an arc shape when viewed in the long-side direction so that the distance therefrom to the photoconductor 62 is constant.

The curved portion 120 is formed by a drawing process such that the curved portion 120 independently maintains the shape thereof. Namely, the curved portion 120 is not elastically deformed such that the shape thereof returns to a flat plate shape when an external force is eliminated, but is plastically deformed such that the curved shape thereof is maintained.

In the present exemplary embodiment, press drawing is performed in the drawing process. However, the drawing process is not limited to this, and roll drawing, for example, may be performed instead.

Figure 3:
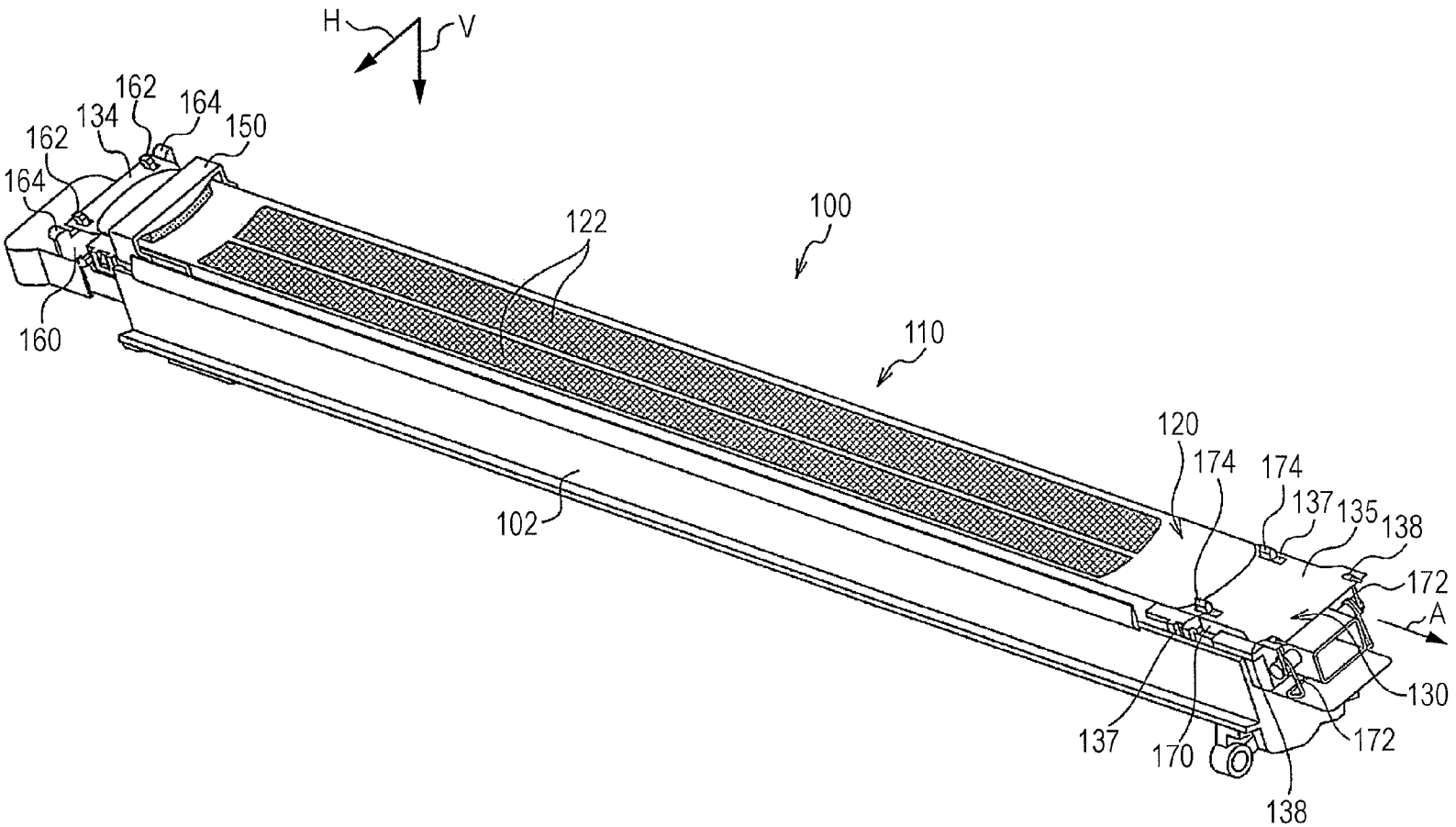
FIG. 3 is a perspective view illustrating the structure of a charging device according to the exemplary embodiment.

As illustrated in FIG. 3, support members 160 and 170 that support the end portions of the grid 110 in the long-side direction thereof are provided in the shield case 102 at the ends of the shield case 102 in the long-side direction thereof.

The support member 160 includes two hook portions 162 that engage with the respective hook holes 136 in the wide portion 134. The two hook portions 162 are arranged next to each other in the short-side direction of the shield case 102.

Contact portions 164 that define the distance between the grid 110 and the photoconductor 62 are formed on the support member 160 at both sides thereof with the two hook portions 162 positioned between the contact portions 164. The contact portions 164 project toward the photoconductor 62 beyond the hook portions 162.

The support member 170 is provided with two torsion springs 172 that engage with the respective hook holes 138 in the wide portion 135. The two torsion springs 172 are arranged next to each other in the short-side direction of the shield case 102. In the state in which the torsion springs 172 are engaged with the hook holes 138 and the hook portions 162 are engaged with the hook holes 136, the grid 110 is urged by the torsion springs 172 in a direction opposite to the direction from the torsion springs 172 to the hook portions 162 (in a direction shown by arrow A in FIG. 3). Thus, a tension is applied to the grid 110 in the long-side direction.

Two contact portions 174 that define the distance between the grid 110 and the photoconductor 62 are formed on the support member 170 at positions corresponding to the torsion springs 172 in central areas of the support member 170 in the long-side direction of the shield case 102. The contact portions 174 project toward the photoconductor 62 beyond the end portions of the torsion springs 172.

As described above, the end portions of the grid 110 in the long-side direction (wide portions 134 and 135) are supported by the hook portions 162 and the torsion springs 172. More specifically, the grid 110 is supported by the hook portions 162 and the torsion springs 172 in areas outside the area to be charged of the photoconductor 62 (to be more specific, in areas opposed to support members that support the photoconductor 62 at the ends thereof in the axial direction). The end portions of the grid 110 in the short-side direction (the linear portions 132) are not supported, and are not in contact with the shield case 102. Thus, the grid 110 according to the present exemplary embodiment is supported only at the end portions thereof in the long-side direction.

The charging device 100 includes a cleaning member 150 that moves in the rotational axis direction of the photoconductor 62 to clean the discharge wires 106 and 108 and the grid 110.

Operation of the Present Exemplary Embodiment

The operation of the present exemplary embodiment will be described.

In the image forming apparatus according to the present exemplary embodiment, the mesh portion 122 of the grid 110 is plastically deformed in an arc shape such that the distance between the mesh portion 122 and the photoconductor 62 is constant. Therefore, the charging efficiency is increased.

In addition, in the present exemplary embodiment, the two discharge wires 106 and 108 are provided and the charging efficiency is increased in each of the discharge wires 106 and 108. Therefore, according to the present exemplary embodiment, the charging efficiency may be effectively increased.

In addition, in the present exemplary embodiment, the grid 110 is plastically deformed by a drawing process. Therefore, the grid 110 independently and effectively maintains the shape thereof. Accordingly, in the structure of the present exemplary embodiment in which the grid 110 is supported only at the end portions thereof in the long-side direction, the distance between the grid 110 and the photoconductor 62 is maintained constant.

In addition, in the present exemplary embodiment, the end portions of the grid 110 in the short-side direction (the linear portions 132) are not supported, and are not in contact with the shield case 102. Accordingly, potential variation in the long-side direction of the grid 110 is reduced. As a result, variation in the charging characteristics in the long-side direction of the grid 110 is reduced.

In addition, in the present exemplary embodiment, the surface of the photoconductor 62 is coated with an overcoat layer that reduces ablation of the surface of the photoconductor 62. Accordingly, the amount of ablation of the surface of the photoconductor 62 is smaller than that in the case in which the photoconductor is not coated with the overcoat layer. Therefore, characteristics of the photoconductor 62 are readily changed by gaseous discharge products generated when the electricity is discharged from the discharge wires, and a large amount of discharge products adhere to the surface of the photoconductor 62 due to the gaseous discharge products. According to the present exemplary embodiment, since the charging efficiency is increased, generation of the gaseous discharge products is reduced. Therefore, even when the photoconductor has the overcoat layer, which is easily influenced by the gaseous discharge products, image defects (density variations or density reduction in the images) due to the generation of the gaseous discharge products are reduced.

Although two discharge wires are provided in the present exemplary embodiment, the number of discharge wires may instead be one or three or more.

Figure 6:
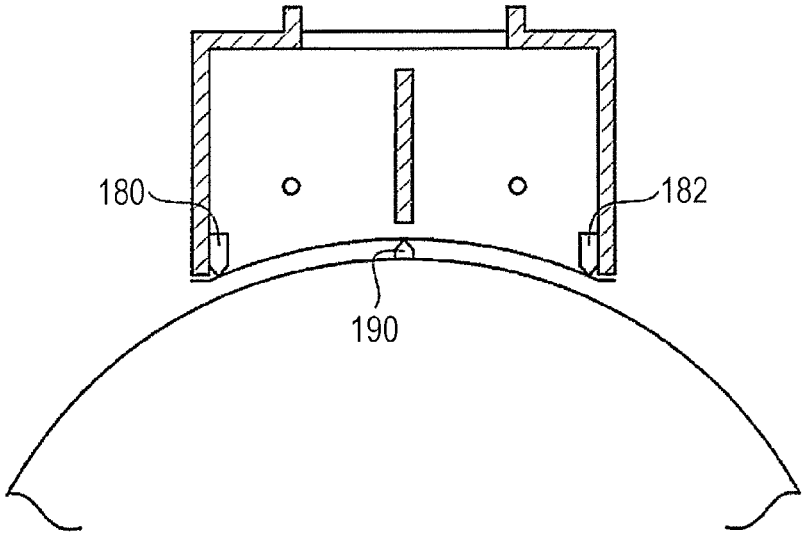
FIG. 6 is a schematic sectional view illustrating the structure of a charging device including a contact member.

In the present exemplary embodiment, as illustrated in FIG. 6, contact members that are in contact with the frame portion 124 of the grid 110 (in areas outside the mesh portion 122 in the long-side direction) may be additionally provided. More specifically, as illustrated in FIG. 6, contact members 180 and 182 that are in contact with the surface of the grid 110 that faces the discharge wires 106 and 108 (upper surface in FIG. 6) may be provided in the shield case 102 at one end thereof in the long-side direction of the shield case 102. The contact member 180 is in contact with the surface of the grid 110 at one end thereof in the short-side direction. The contact member 182 is in contact with the surface of the grid 110 at the other end thereof in the short-side direction.

The contact members 180 and 182 are, for example, provided on the support member 160. The contact members 180 and 182 are in contact with the frame portion 124 of the curved portion 120 (portion other than the mesh portion 122) at the part of the frame portion 124 that is plastically deformed in an arc shape such that the distance to the photoconductor 62 is constant.

In addition, as illustrated in FIG. 6, a contact member 190 that is in contact with the back surface of the grid 110 that faces the photoconductor 62 (lower surface in FIG. 6) may be provided on a support member that supports the photoconductor 62 at one end thereof in the axial direction. The contact member 190 is in contact with the back surface of the grid 110 at the middle position between the contact positions of the contact members 180 and 182, that is, at the central position of the grid 110 in the short-side direction. The contact member 190 is in contact with the frame portion 124 of the curved portion 120 (portion other than the mesh portion 122) at the part of the frame portion 124 that is plastically deformed in an arc shape such that the distance to the photoconductor 62 is constant.

The contact members 180, 182, and 190 are also provided at the other end of the grid 110 in the long-side direction, and are in contact with the grid 110.

In the present exemplary embodiment, at least the mesh portion 122 of the grid 110 is plastically deformed in an arc shape so that the distance between the mesh portion 122 and the photoconductor 62 is constant. However, the grid 110 may instead be formed in a curved shape along the outer peripheral surface of the photoconductor 62 as described below.

First Modification of Grid 110

Figure 7:
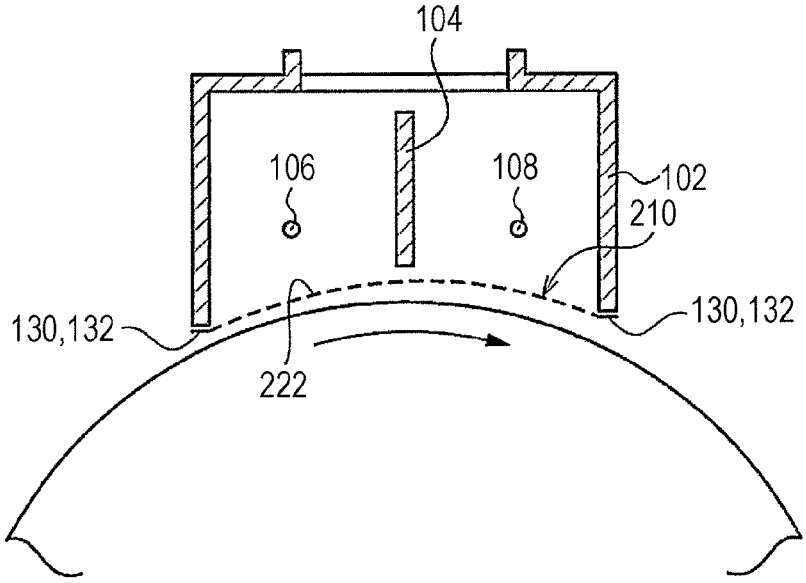
FIG. 7 is a schematic sectional view illustrating the structure of a charging device including a grid of a first modification.

As illustrated in FIG. 7, a grid 210 according to a first modification includes a mesh portion 222 that independently maintains a curved shape thereof whose curvature gradually increases from the upstream side to the downstream side in the rotational direction of the photoconductor 62. Accordingly, the distance between the mesh portion 222 and the photoconductor 62 gradually increases from the upstream side to the downstream side in the rotational direction of the photoconductor 62.

In general, sensitivity to the control potential controlled by the grid 210 is higher at the downstream side in the rotational direction of the photoconductor 62 than at the downstream side. When the distance between the photoconductor 62 and the mesh portion 222 is increased at the downstream side in the rotational direction of the photoconductor 62, the difference in sensitivity between the upstream side and the downstream side in the rotational direction of the photoconductor 62 is reduced.

Accordingly, even when the charge potential varies in the rotational axis direction of the photoconductor 62 at the downstream side of the grid 210 in the rotational direction of the photoconductor 62, the influence of the variation in the charge potential may be reduced.

Although two discharge wires are provided in the first modification, the number of discharge wires may instead be one or three or more.

Second Modification of Grid 110

Figure 8:
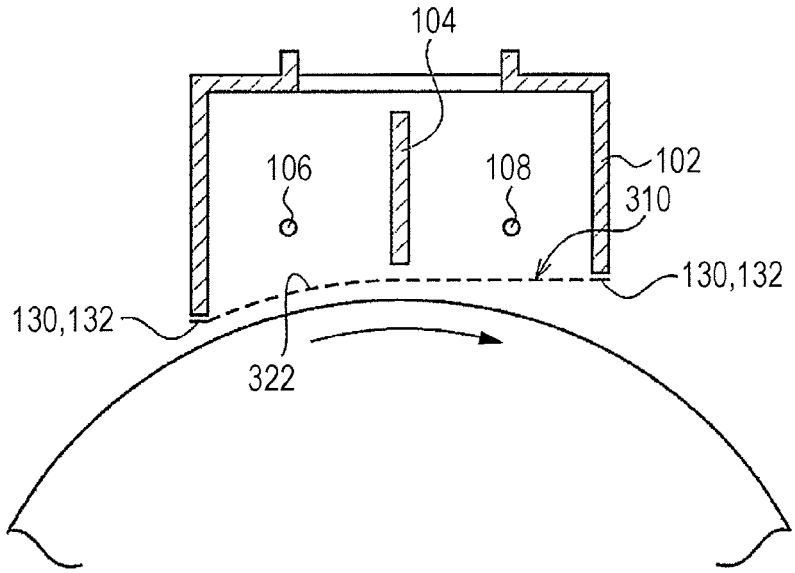
FIG. 8 is a schematic sectional view illustrating the structure of a charging device including a grid of a second modification.

As illustrated in FIG. 8, a grid 310 according to a second modification includes a mesh portion 322 having an upstream portion and a downstream portion in the rotational direction of the photoconductor 62. The upstream portion is plastically deformed in an arc shape such that the distance between the upstream portion and the photoconductor 62 is constant when viewed in the long-side direction. The downstream portion is flat plate shaped. Accordingly, the distance between the mesh portion 322 and the photoconductor 62 gradually increases from the upstream side to the downstream side in the rotational direction of the photoconductor 62.

With this structure, similar to the first modification, since the distance between the photoconductor 62 and the mesh portion 222 is increased at the downstream side in the rotational direction of the photoconductor 62, the difference in sensitivity between the upstream side and the downstream side in the rotational direction of the photoconductor 62 is reduced.

Accordingly, even when the charge potential varies in the rotational axis direction of the photoconductor 62 at the downstream side of the grid 310 in the rotational direction of the photoconductor 62, the influence of the variation in the charge potential may be reduced.

In addition, since ionic wind generated by the charging device 100 flows along the grid 310, the ionic wind blows downstream in the rotational direction of the photoconductor 62. Accordingly, the gaseous discharge products may be easily discharged.

Although two discharge wires are provided in the second modification, the number of discharge wires may instead be one or three or more.

Third Modification of Grid 110

Figure 9:
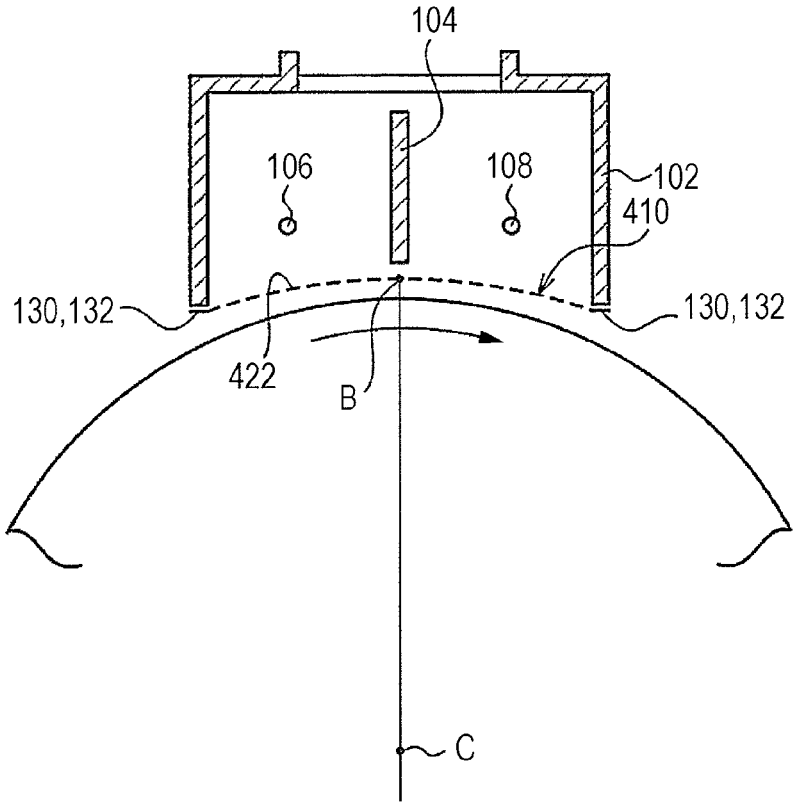
FIG. 9 is a schematic sectional view illustrating the structure of a charging device including a grid of a third modification.

As illustrated in FIG. 9, a grid 410 according to a third modification includes a mesh portion 422 that independently maintains an arc shape thereof whose curvature is larger than that of a circle having line BC connecting the central point B of the grid 410 in the short-side direction and the rotational center C of the photoconductor 62 as a radius. Accordingly, the distance between the mesh portion 422 and the photoconductor 62 gradually increases from the central position in the rotational direction of the photoconductor 62 toward the upstream side in the rotational direction, and also gradually increases from the central position in the rotational direction of the photoconductor 62 toward the downstream side in the rotational direction. Thus, in the third modification, the distance between the mesh portion 422 and the photoconductor 62 gradually increases toward the downstream side in the rotational direction of the photoconductor 62 in a downstream area in the rotational direction of the member to be charged including the downstream end of the mesh portion 422 in the rotational direction.

Although two discharge wires are provided in the third modification, the number of discharge wires may instead be one or three or more.

Fourth Modification of Grid 110

Figure 10:
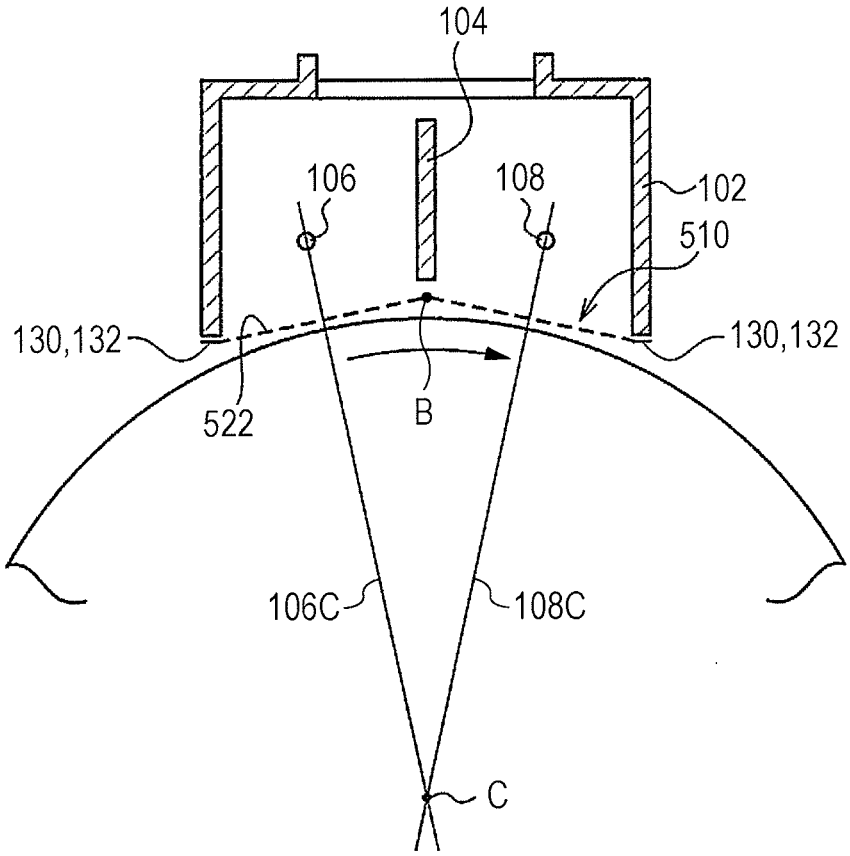
FIG. 10 is a schematic sectional view illustrating the structure of a charging device including a grid of a fourth modification.

As illustrated in FIG. 10, a grid 510 according to a fourth modification includes a mesh portion 522 that is bent at the central point B of the grid 510 in the short-side direction. The mesh portion 522 is orthogonal to line 106C connecting the discharge wire 106 and the rotational center C of the photoconductor 62 in an area on the upstream side of the central point B in the rotational direction of the photoconductor 62, and is orthogonal to line 108C connecting the discharge wire 108 and the rotational center C of the photoconductor 62 in an area on the downstream side of the central point B in the rotational direction of the photoconductor 62.

Although two discharge wires are provided in the fourth modification, the number of discharge wires may instead be three or more. In addition, although the partition plate 104 is provided in the fourth modification, the partition plate 104 may be omitted.

Structure of Image Forming Apparatus Including Charging Device 100

Application examples of image forming apparatuses including the charging device 100 according to the present exemplary embodiment other than the above-described image forming apparatus 10 will be described. Here, two application examples will be described.

Structure of Image Forming Apparatus of First Application Example

Figure 11:
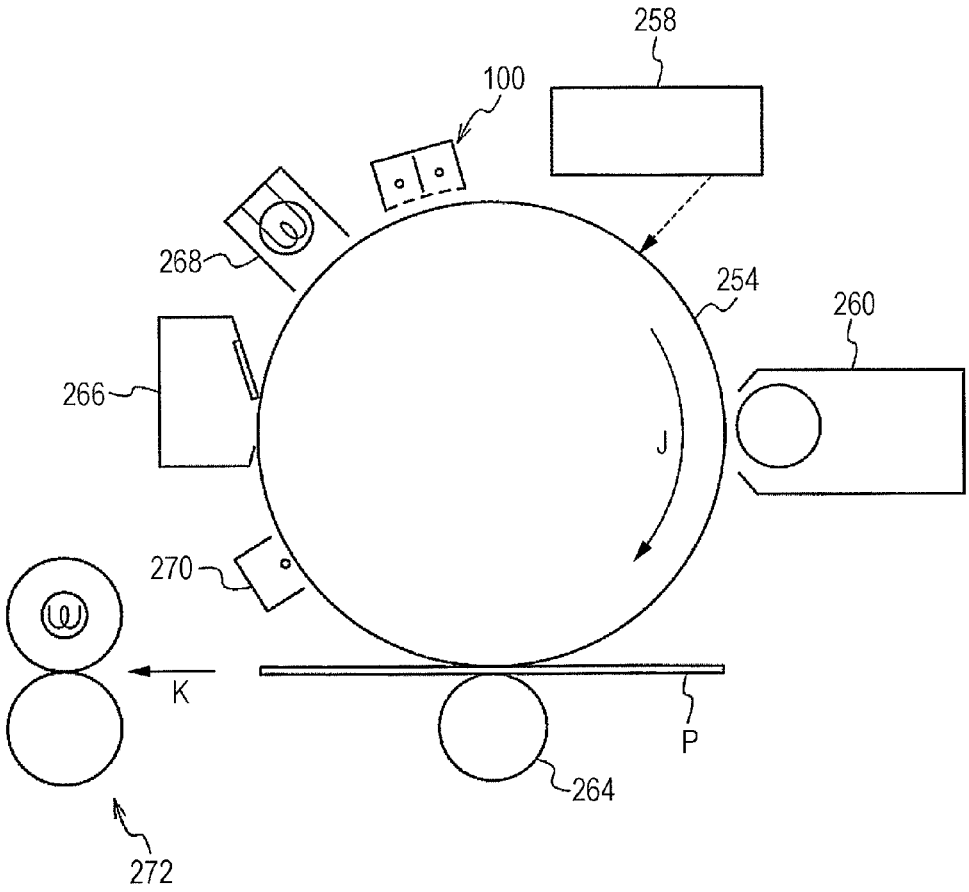
FIG. 11 is a schematic diagram illustrating the structure of an image forming apparatus according to a first application example.

FIG. 11 is a schematic diagram illustrating the structure of an image forming apparatus according to a first application example.

Referring to FIG. 11, a photoconductor (image carrier) 254 is an electrostatic latent image carrier that rotates in the direction shown by arrow J. A toner-image forming unit, a transfer device (transfer unit) 264, an erase device 270, a blade-type cleaning device (cleaning unit) 266, and an erase unit 268 are arranged in that order around the photoconductor 254. The toner-image forming unit includes the above-described charging device 100 that uniformly charges the surface of the photoconductor 254, an exposure device (electrostatic-latent-image forming unit) 258 that forms an electrostatic latent image by irradiating the surface of the photoconductor 254 with light corresponding to an image, and a developing device (developing unit) 260 that forms a toner image by supplying two-component developer including toner and carrier to the surface of the photoconductor 254 and developing the electrostatic latent image. The transfer device 264 transfers the toner image formed on the surface of the photoconductor 254 onto a sheet of paper (recording medium) P. The erase device 270 eliminates the charge history left by the transfer device 264 by discharging electricity toward the outer peripheral surface of the photoconductor 254. The cleaning device 266 removes impurities, such as the toner and dust, that remain on the surface of the photoconductor 254. The erase unit 268 removes the electrostatic latent image on the surface of the photoconductor 254. A fixing device (fixing unit) 272 that fixes the toner image that has been transferred onto the sheet of paper P is disposed downstream of the transfer device 264 in a transporting direction of the sheet of paper P (direction shown by arrow K).

The exposure device 258 may be, for example, an optical device capable of irradiating the surface of the photoconductor 254 with light from a light source, such as a semiconductor laser, a light emitting diode (LED), or a liquid crystal shutter, in accordance with a desired image. In particular, an exposure device capable of emitting incoherent light is preferably used.

The developing device 260 contains the two-component developer including toner (volume average particle diameter: 5.8 μm) and carrier. The carrier in the two-component developer forms a magnetic brush on the surface of a developing sleeve (developer carrier), so that the toner is supplied to the surface of the photoconductor 254 and the electrostatic latent image is developed.

In this example, a roller-shaped contact transfer charger (transfer device 264) is used as the transfer unit. However, a contact transfer charger including a belt, a film, a rubber blade, etc., may be used instead. Alternatively, a scorotron transfer charger or a corotron transfer charger, both of which utilize corona discharge, may be used.

The erase device 270 discharges, for example, negative electricity toward the outer peripheral surface of the photoconductor 254 before the residual toner and the like are collected by the cleaning device 266. Accordingly, the history of positive electric charge applied by the transfer device 264 is eliminated, and the image forming process of the next cycle is prevented from being affected by the electric charge.

In this example, the cleaning device 266 including a cleaning blade made of an elastic material, such as rubber, is used as the cleaning unit. The cleaning blade is in contact with the surface of the photoconductor 254 at one edge thereof so as to remove the toner and the like that adhere to the surface of the photoconductor 254. However, in the present exemplary embodiment, cleaning units using other known cleaning methods, such as a brush made of a conductive plastic material, may be used instead.

The fixing device 272 may be, for example, a two-roller fixing unit including a pair of roller-shaped image fixing members. However, other known types of fixing units may, of course, be used in the present exemplary embodiment.

The surface of the photoconductor 254 that rotates in the direction shown by arrow J is uniformly charged by the charging device 100, and is then exposed to light by the exposure device 258 in accordance with image information. Thus, an electrostatic latent image based on the potential difference between the exposed and non-exposed portions is formed on the surface of the photoconductor 254. Then, the toner that is charged to a certain potential is supplied to the surface of the photoconductor 254 by the developing device 260, so that the electrostatic latent image is developed into a toner image. Then, the toner image is transferred onto the surface of the sheet of paper P by the transfer device 264. The sheet of paper P having the unfixed toner image on the surface thereof is transported in the direction shown by arrow K and is inserted into a nip section in the fixing device 272. Then, heat and pressure are applied to the sheet of paper P so that the toner is melted and fixed to the sheet of paper P. Thus, a permanent image is formed.

After the toner image is transferred, the erase device 270 discharges electricity toward the surface of the photoconductor 254 to eliminate the charge history left by the transfer device 264. Then, dust (impurities) including the residual toner that has not been transferred onto the sheet of paper P by the transfer device 264 and paper dust is removed by the cleaning device 266. Then, the electrostatic latent image that remains on the surface of the photoconductor 254 is removed by the erase unit 268. Thus, a single cycle of the image forming process is completed, and the apparatus prepares for the next cycle.

Structure of Image Forming Apparatus of Second Application Example

Figure 12:
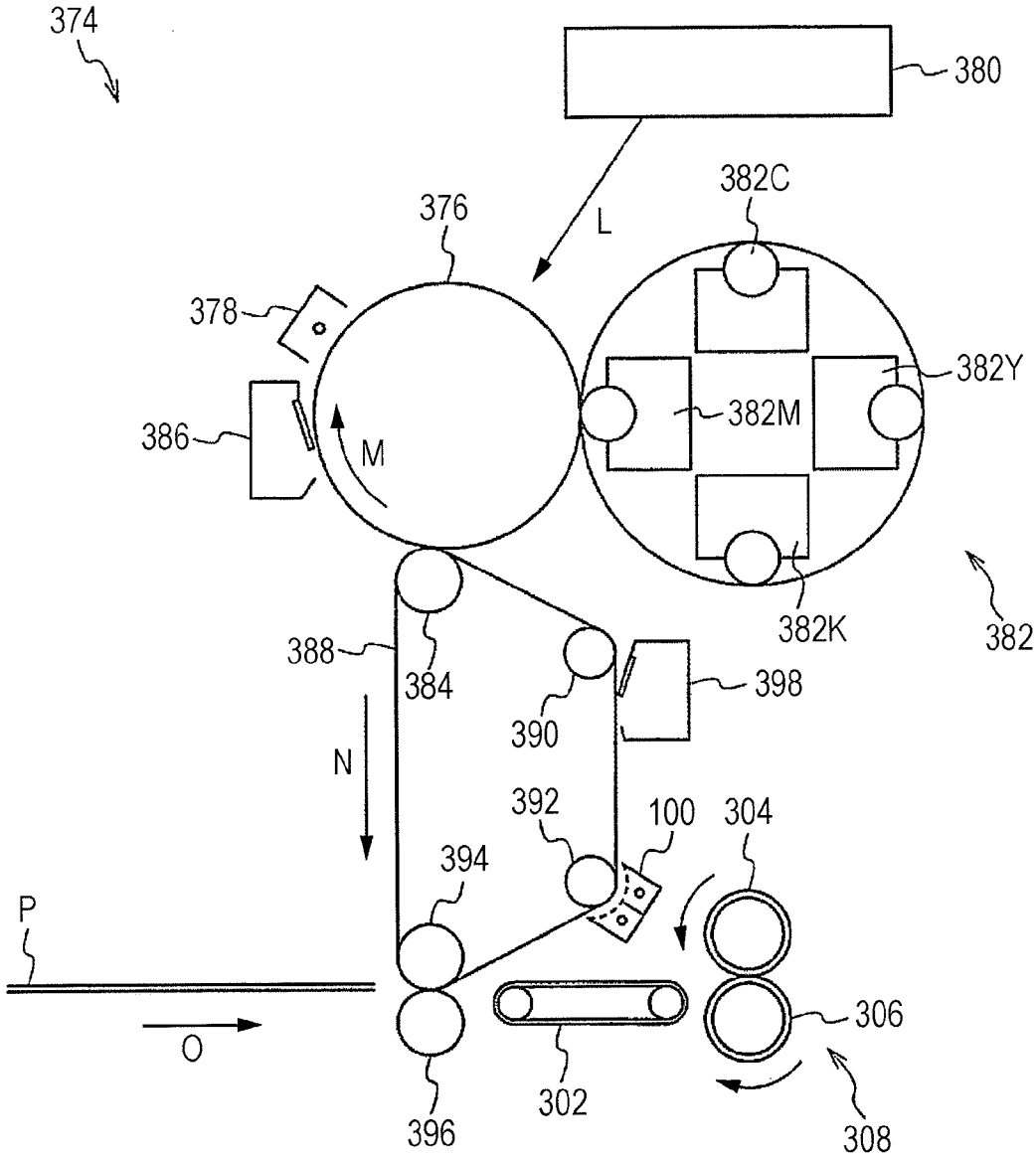
FIG. 12 is a schematic diagram illustrating the structure of an image forming apparatus according to a second application example.

FIG. 12 is a schematic diagram illustrating the structure of an image forming apparatus according to a second application example.

An image forming apparatus 374 includes a toner-image forming unit, an intermediate transfer body 388, three support rollers 390, 392, and 394, a second transfer roller 396, the above-described charging device 100, a blade-type intermediate-transfer-body cleaning device (cleaning unit) 398, a transport belt 302, and a fixing device (fixing unit) 308. The toner-image forming unit includes a photoconductor (electrostatic-latent-image carrier) 376, a charging device 378 that functions as a charging unit, an exposure device 380 that functions as an electrostatic-latent-image forming unit, a rotary developing device 382 that functions as a developing unit, a first transfer roller 384 that functions as an intermediate transfer unit, and a cleaning device 386 including a cleaning blade. The intermediate transfer body 388 receives toner images of different colors in a superimposed manner and simultaneously transfers the toner images onto a sheet of recording paper (recording medium) P. The intermediate transfer body 388 is wound around and supported by the first transfer roller 384 and the support rollers 390, 392, and 394. The second transfer roller 396 functions as a second transfer unit (transfer unit). The charging device 100 functions as an erase device that eliminates the charge history left by the second transfer roller 396 by discharging electricity toward the outer peripheral surface of the second transfer roller 396. The intermediate-transfer-body cleaning device 398 removes impurities, such as the toner and dust, that remain on the surface of the intermediate transfer body 388. The transport belt 302 transports the sheet of recording paper P after the second transfer process. The fixing device 308 places the sheet of recording paper P that has been transported by the transport belt 302 between two rollers, which are a heating roller 304 and a pressure roller 306, and fixes the toner image by applying heat and pressure.

The photoconductor 376 is drum-shaped and includes a photosensitive layer at the outer peripheral surface (drum surface) thereof. The photoconductor 376 is rotatable in the direction shown by arrow M in FIG. 12. The charging device 378 uniformly charges the surface of the photoconductor 376. The exposure device 380 forms electrostatic latent images by ejecting light L corresponding to an image toward the photoconductor 376 that has been uniformly charged by the charging device 378.

The rotary developing device 382 includes four developing units 382Y, 382M, 382C, and 382K that contain yellow toner, magenta toner, cyan toner, and black toner. In this apparatus, the developing unit 382Y contains yellow toner, the developing unit 382M contains magenta toner, the developing unit 382C contains cyan toner, and the developing unit 382K contains black toner.

The rotary developing device 382 rotates such that the above-described four developing units 382Y, 382M, 382C, and 382K successively face the photoconductor 376 in the vicinity thereof. Accordingly, the toners are supplied to electrostatic latent images of the respective colors, and a toner image is formed.

The first transfer roller 384 transfers the toner image formed on the surface of the photoconductor 376 onto the outer peripheral surface of the intermediate transfer body 388, which is endless-belt-shaped, while the intermediate transfer body 388 is held between the first transfer roller 384 and the photoconductor 376 (first transfer process). The cleaning device 386 performs a cleaning process of removing the toner and the like that remain on the surface of the photoconductor 376 after the transfer process. The intermediate transfer body 388 is wound around the support rollers 390, 392, and 394 and the first transfer roller 384, and is supported such that the intermediate transfer body 388 is rotatable in the direction shown by arrow N and the direction opposite thereto. The second transfer roller 396 transfers the toner image on the outer peripheral surface of the intermediate transfer body 388 onto the sheet of recording paper (recording medium) P, which is transported in the direction shown by error O by a sheet transporting unit (not shown), while the sheet is held between the second transfer roller 396 and the support roller 394 (second transfer process).

The photoconductor (electrostatic-latent-image carrier) 376, the charging device (charging unit) 378, the exposure device (electrostatic-latent-image forming unit) 380, and the fixing device (fixing unit) 308 in the image forming apparatus 374 illustrated in FIG. 12 are similar to the fixing device 272, etc., of the image forming apparatus according to the first application example and detailed explanations thereof are thus omitted.

In addition, the first transfer roller (intermediate transfer unit) 384 and the second transfer roller (transfer unit) 396 are similar to the transfer device 264, and the cleaning device 386 and the intermediate-transfer-body cleaning device 398 are similar to the cleaning device 266. Therefore, detailed explanations of these components are also omitted.

A known intermediate transfer body may be used as the intermediate transfer body. Examples of materials of the intermediate transfer body include polycarbonate resin (PC), polyvinylidene fluoride (PAD), polyalkylene phthalate, a blended material of PC and polyalkylene terephthalate (PAT), a blended material of ethylene tetrafluoroethylene copolymer (TEE) and PC, a blended material of TEE and PAT, and a blended material of PC and PAT. In view of mechanical strength, an intermediate transfer belt made of thermosetting polyimide resin is preferably used. Although a belt-shaped intermediate transfer body is used in this example, a drum-shaped (cylindrical) intermediate transfer body may be used instead.

The charging device 100 is opposed to the support roller 392 with the intermediate transfer body 388 disposed therebetween. The intermediate transfer body 388 is an example of a member to be charged that rotates and has an arc-shaped outer peripheral surface. In other words, the charging device 100 faces the outer peripheral surface of an arc-shaped portion of the intermediate transfer body 388 that is wound around the support roller 392. The charging device 100 discharges, for example, negative electricity toward the outer peripheral surface of the intermediate transfer body 388 before the residual toner and the like are collected by the cleaning device 398. Accordingly, the history of positive electric charge left by the second transfer roller 396 is eliminated, and the image forming process of the next cycle is prevented from being affected by the electric charge.

The image forming apparatus 374 successively forms toner images on the surface of the photoconductor 376 and transfers the toner images onto the outer peripheral surface of the intermediate transfer body 388 in a superimposed manner. More specifically, first, the photoconductor 376 is rotated and the surface of the photoconductor 376 is uniformly charged by the charging device 378 (charging step). Then, the photoconductor 376 is irradiated with light corresponding to a magenta image by the exposure device 380, so that an electrostatic latent image is formed.

The electrostatic latent image is developed into a toner image by the magenta developing unit 382M, and then the toner image is transferred onto the outer peripheral surface of the intermediate transfer body 388 by the first transfer roller 384. The magenta toner that remains on the surface of the photoconductor 376 instead of being transferred onto the intermediate transfer body 388 is removed by the cleaning device 386.

The intermediate transfer body 388 having the magenta toner image on the outer peripheral surface thereof is rotated in the direction opposite to the direction shown by arrow N while carrying the magenta toner image (the photoconductor 376 and the intermediate transfer body 388 are separated from each other at this time). Then, the intermediate transfer body 388 is moved to a position such that the next toner image, for example, a cyan toner image, is transferred onto the magenta toner image in a superimposed manner.

Then, the charging performed by the charging device 378, the irradiation with light corresponding to an image performed by the exposure device 380, the toner-image formation performed by each of the developing units 382C, 382Y, and 382K, and transferring of the toner image onto the outer peripheral surface of the intermediate transfer body 388 are repeated for each of the cyan toner, the yellow toner, and the black toner.

After the four toner images of the respective colors are transferred onto the outer peripheral surface of the intermediate transfer body 388, the toner images are simultaneously transferred onto the sheet of recording paper P by the second transfer roller 396 (second transfer process). Accordingly, a recording image is formed on an image forming surface of the sheet of recording paper P, the recording image including the magenta toner image, the cyan toner image, the yellow toner image, and the black toner image that are superimposed in that order on the image forming surface. After the toner images are transferred onto the surface of the sheet of recording paper P by the second transfer roller 396, the toner images are thermally fixed by the fixing device 308 (fixing step).

Although two image forming apparatuses having structures illustrated in FIGS. 11 and 12 are described as examples, the charging device 100 according to the present exemplary embodiment may be applied to other known electrophotographic image forming apparatuses. In any case, the image forming apparatuses constitute the image forming apparatuses of the present invention.

For example, in the above-described exemplary embodiment, a rotary developing device including the same number of developing units as the number of colors is used to successively form latent images of respective colors on a single photoconductor 376 and transfer the images onto the intermediate transfer body 388 one at a time. However, the present invention may also be applied to a so-called tandem image forming apparatus which includes the same number of toner-image forming units as the number of colors, each toner-image forming unit including a photoconductor, a charging unit, a developing unit, and a cleaning unit. The toner-image forming units for the respective colors are arranged next each other so as to face an intermediate transfer body (it is not necessary to physically arrange the units on a single straight line). Toner images of the respective colors are formed by the respective units, and are successively transferred onto the intermediate transfer body in a first transfer process. Then, the toner images are simultaneously transferred onto a recording medium in a second transfer process.

The present invention is not limited to the above-described exemplary embodiment, and various modifications, alterations, and improvements are possible. For example, the above-described modifications may be applied in combinations.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a discharge electrode that extends along a rotational axis direction of a member to be charged that rotates and has an arc-shaped outer peripheral surface, the discharge electrode being arranged to face the outer peripheral surface;

a potential control plate arranged between the outer peripheral surface of the member to be charged and the discharge electrode and extending in the rotational axis direction of the member to be charged, the potential control plate being plastically deformed so as to independently maintain the shape of the potential control plate; and a support member that supports the potential control plate only at both end portions of the potential control plate in a long-side direction of the potential control plate, wherein the potential control plate is plastically deformed in an arc shape such that a curvature of the arc shape is larger than that of the member to be charged.

2. The charging device according to claim 1, wherein a part between the both end portions of the potential control plate is disposed in a contactless manner.

3. The charging device according to claim 1, wherein the potential control plate is plastically deformed such that a distance between the potential control plate and the member to be charged increases toward a downstream side in the rotational direction of the member.

4. The charging device according to claim 3, wherein the number of the discharge electrodes is two or more.

5. The charging device according to claim 1, wherein the number of the discharge electrodes is two or more.

6. An image forming apparatus comprising:

the charging device according to claim 1; and a photoconductor including an overcoat layer and serving as the member to be charged by the charging device.

7. The charging device according to claim 1, wherein the potential control plate includes a curved portion that is curved so as to project toward the discharge electrode and a frame portion provided at an outer periphery of the curved portion so as to surround the curved portion.

8. The charging device according to claim 7, wherein the curved portion has a meshed pattern portion.

9. The charging device according to claim 7, wherein the frame portion has a flat surface.

10. The charging device according to claim 1, wherein the potential control plate has an upstream portion and a downstream portion in the rotational direction of the member to be charged, the upstream portion being plastically deformed in the arc shape, and the downstream portion being shaped with a flat surface.

11. The charging device according to claim 1, wherein the potential control plate is deformed by a drawing process.

12. An image forming apparatus, comprising:

a charging device comprising:

a discharge electrode that extends along a rotational axis direction of a member to be charged that rotates and has an arc-shaped outer peripheral surface, the discharge electrode being arranged to face the outer peripheral surface;

a potential control plate arranged between the outer peripheral surface of the member to be charged and the discharge electrode and extending in the rotational axis direction of the member to be charged, the potential control plate being plastically deformed so as to independently maintain the shape of the potential control plate;

a support member that supports the potential control plate only at both end portions of the potential control plate in a long-side direction of the potential control plate;

a contact member that is in contact with a surface of the potential control plate at an end portion of the potential control plate in the long-side direction, the surface facing the discharge electrode;

a photoconductor that serves as the member to be charged by the charging device; and a contact member provided on an end portion of the photoconductor in an axial direction, the contact member being in contact with a back surface of the potential control plate at the end of the potential control plate in the long-side direction, the back surface being at a side opposite to the surface that faces the discharge electrode.

* * * * *